United States Patent [19]

Johnston et al.

[11] 4,375,852

[45] Mar. 8, 1983

[54] CORNER AND EDGE PROTECTOR

[75] Inventors: Robert E. Johnston, Lake Zurich; Kishor N. Kudalkar, Carol Stream, both of Ill.

[73] Assignee: Weyerhaeuser Company, Tacoma, Wash.

[21] Appl. No.: 300,403

[22] Filed: Sep. 8, 1981

[51] Int. Cl.[3] ..... B65D 81/04

[52] U.S. Cl. ..... 206/586; 229/DIG. 1

[58] Field of Search ..... 206/591, 593, 586, 453, 206/320; 229/DIG. 1; 217/23, 35

[56] References Cited

U.S. PATENT DOCUMENTS

| | | | |
|---|---|---|---|
| 2,324,031 | 7/1943 | Schiffenhaus | 206/586 |
| 2,609,136 | 9/1952 | Sider | 206/586 X |
| 3,655,112 | 4/1972 | Jeffers | 229/DIG. 1 X |
| 3,684,636 | 8/1972 | Rothrock, Jr. et al. | 229/DIG. 1 X |
| 3,980,221 | 9/1976 | Okada | 206/586 X |
| 4,000,843 | 1/1977 | Sorensen et al. | 206/586 |
| 4,127,192 | 11/1978 | Card | 229/DIG. 1 X |

*Primary Examiner*—William T. Dixson, Jr.
*Assistant Examiner*—Gary E. Elkins
*Attorney, Agent, or Firm*—Weyerhaeuser Company

[57] ABSTRACT

A blank which is scored and cut so that it may be folded into a corner protector. A blank is scored to provide a series of side, bottom and top panels. There are aligned apertures in the side panels which allow a blank to be bent to form a pair of angularly aligned elements.

8 Claims, 5 Drawing Figures

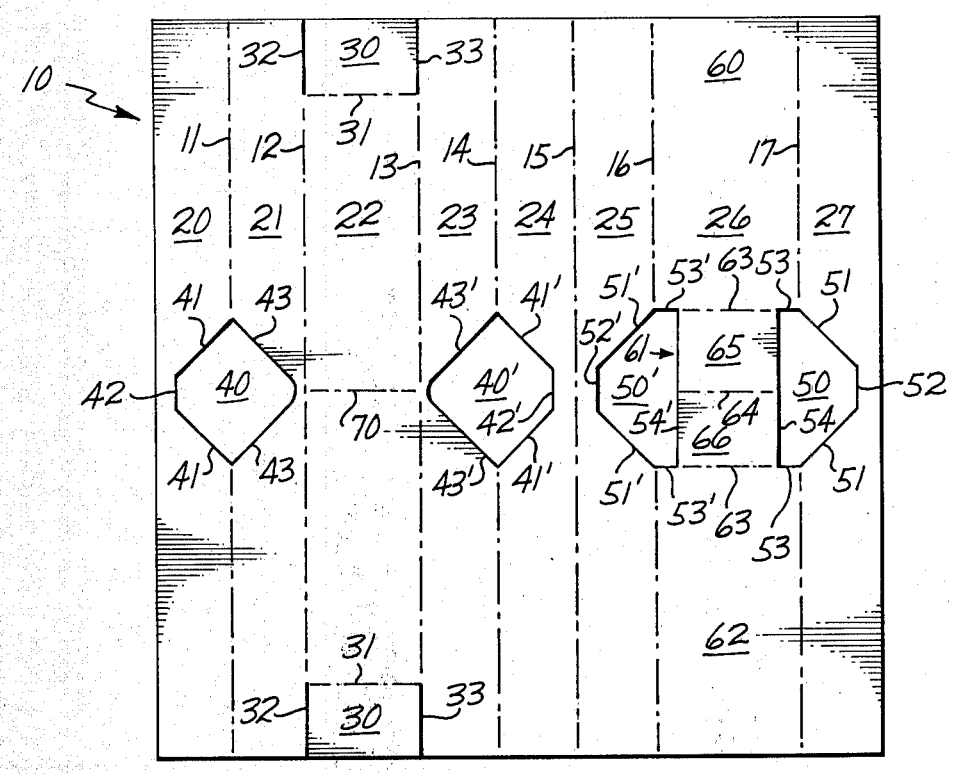
Fig. 1
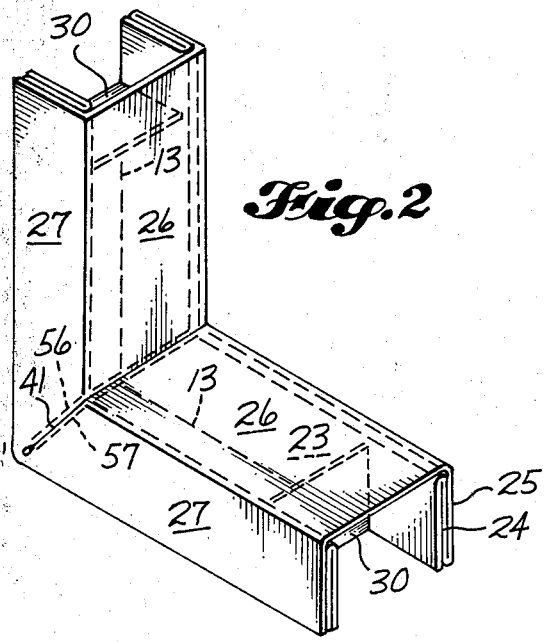
Fig. 2
Fig. 5
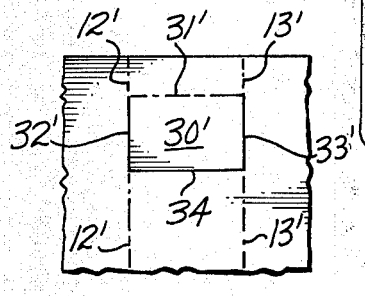

CORNER AND EDGE PROTECTOR

BACKGROUND OF THE INVENTION

Field of the Invention

A blank for a tubular element for protecting the corners and edges of articles.

SUMMARY OF THE INVENTION

A blank which is scored and cut so that it may be folded into a corner protector. A blank is scored to provide a series of side, bottom and top panels. There are aligned apertures in the side panels which allow a blank to be bent to form a pair of angularly aligned elements.

BRIEF DESCRIPTION OF THE DRAWINGS

FIG. 1 is a top plan view of a blank of the protector.

FIG. 2 is an isometric view of the completed protector.

FIG. 5 is a top plan view of a portion of a modified blank.

DESCRIPTION OF A PREFERRED EMBODIMENT

Figure 3:
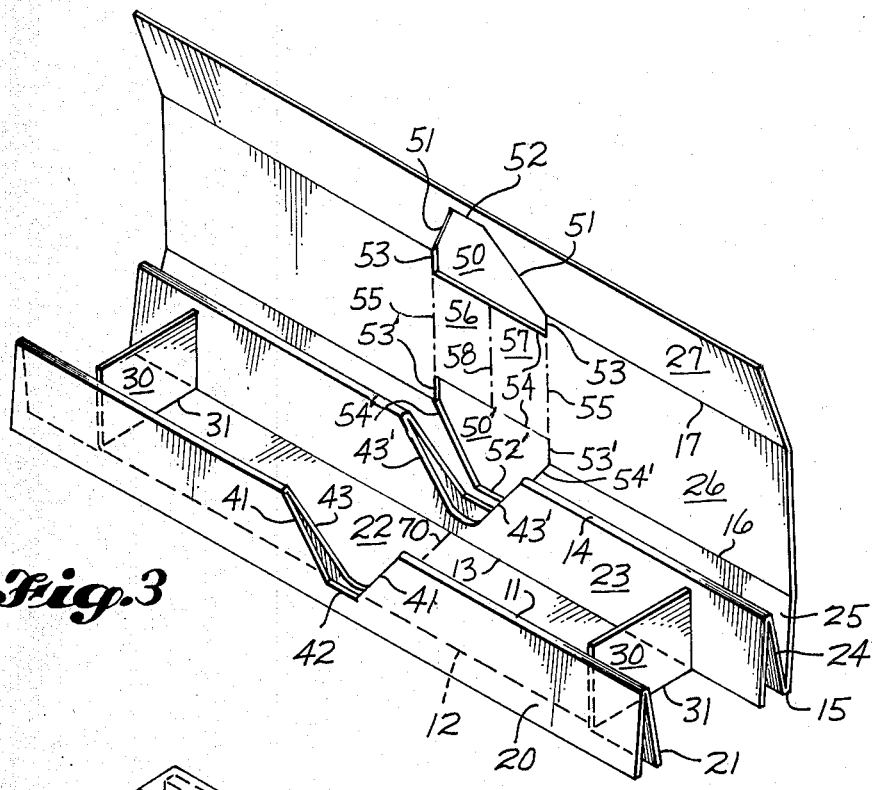
FIGS. 3 and 4 are isometric views showing the protector being formed.

Blank 10 is divided by score lines, 11, 12, 13, 14, 15, 16, and 17 into a first intermediate side panel 20, a first interior side panel 21, a bottom panel 22, a second interior side panel 23, a second intermediate side panel 24, a first exterior side panel 25, a top panel 26 and a second exterior side panel 27. The bottom panel 22 does not extend the entire length of the protector. A pair of spacer tabs 30 are formed at each end of the bottom panel 22 by the transverse score lines 31 which extend across the ends of the bottom panel 22, cut lines 32 which are aligned with or slightly offset from score line 12 and cut lines 33 which are aligned with or slightly offset from score line 13. The tabs may face outwardly, as shown in FIGS. 1–4, or inwardly as shown in FIG. 5. In this latter configuration, the score line 31' is the outer edge of the tab 30'. The cut lines 32' and 33' extend inwardly of score line 31'; and transverse cut line 34 extends between the inner ends of cut lines 32' and 33'.

A pair of interior apertures are formed in the intermediate and interior side panels. These apertures 40 are approximately midway the length of the protector and are formed by a first pair of diagonal edges 41, a second pair of diagonal edges 43, and a longitudinal edge 42. The diagonal edges 41 extend outwardly from score line 11 toward the side edge of intermediate side panel 20. They are at an angle of approximately 45° to the score line 11 and at an angle of 90° to each other. Longitudinal edge 42 extends between the edges 41 and is substantially parallel to the exterior side edge of panel 20 and is spaced from that side edge. Diagonal edges 43 extend from the juncture of edges 41 with score line 11 and meet each other at score line 12. The edges 43 are also at an angle of 45° to the score line 12 and at an angle of 90° to each other. In the completed container the edges 41 and 43 are contiguous, although edges 43 and 43' extend beneath edges 42 and 42'. In the same manner, edges 41' of aperture 40' extend from score line 14 towards score line 15 and are at an angle of 45° to the score line 14 and 90° to each other. The longitudinal edge 42' extends between the edges 41', is substantially parallel to the score line 15 and is spaced from that score line. The edges 43' extend from the juncture of the edges 41' with score line 14 and meet each other at score line 13. These edges are both at an angle of 45° to score line 13 and 90° to each other. Edges 43' are contiguous with edges 41' in the completed protector.

A set of exterior apertures 50 and 50' are formed in the exterior side walls and top wall. The aperture 50 is formed by diagonal edges 51 which extend from score line 17 toward the outer edge of panel 27 and are at an angle of 45° to the score line 17 and 90° to each other. The edge 52 extends longitudinally of the panel 27 between the edges 51, is substantially parallel to the outer edge of panel 27 and is spaced inwardly from the outer edge. The edges 53 are substantially perpendicular to score line 17 and extend from the juncture of edge 51 with the score line 17 a slight distance into panel 26. Edge 54 extends between the ends of edges 53 and is substantially parallel to score line 17. The other exterior aperture 50' extends into panel 25. It too is formed by edges 51', 52', 53' and 54' which have the same relationship as edges 51, 52, 53 and 54. In the completed container, the edges 51 and 52 are contiguous with the edges 41 and 42 and the edges 51' and 52' are contiguous with the edges 41' and 42'.

Top panel 26 is divided into a first section 60, a bridge section 61 and a second section 62 by score lines 63 which extend across panel 26 and are aligned with the edges 53. Another score line 64 extends between the apertures 50 and 50' is parallel to the score lines 63 and is midway between these score lines. It divides bridge section 61 into first and second bridge elements 65 and 66.

The protector is formed by reverse folding the intermediate and interior side panels 20 and 21 around score line 11 so that intermediate side panel 20 is outside the interior side panel 21. The two panels are bent upwardly around score line 12 to be perpendicular to the bottom panel 22. In a similar manner, second intermediate and interior side panels 24 and 23 are bent around score line 14 so that panel 24 is outside of second interior panel 23. These are also bent upwardly around score line 13 so that they are perpendicular to the bottom panel 22. The spacer panels 30 are bent upwardly around score lines 31 to extend between the interior panels 21 and 23. First exterior side panel 25 is then bent upwardly around score line 15. The top panel 26 is bent inwardly around score line 16 and second exterior side panel 27 is bent downwardly around score line 17 to overlie first intermediate side panel 20.

Figure 4:
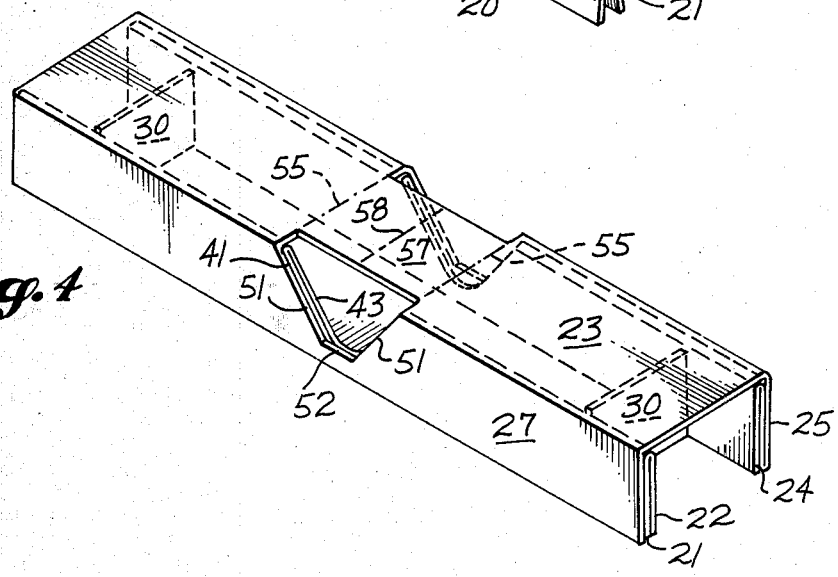

In this configuration shown in FIG. 4, the edges 51, 41 and 43 are contiguous, the edges 51', 41' and 43' are contiguous, the longitudinal edges 52 and 42 are contiguous, and the longitudinal edges 52' and 42' are contiguous. In the blanks, the meeting point of both edges 43 and edges 43' is rounded slightly and that meeting point does not coincide with edges 42 and 42'.

A score line 70 extends between the meeting points of edges 43 and edges 43'. The protector is not bent around score line 70 and elements 65 and 66 are bent inwardly around score lines 63 and 64 so that the elements are contiguous in the formed edge protector.

The diagonal edges of each pair of diagonal edges are substantially aligned in the formed protector shown in FIG. 2.

At all the meeting points of edges forming the apertures, a slight radius is used to have a clean cut off during die-cutting of the blank.

We claim:

1. A blank for an edge protector comprising a rectangular corrugated board divided by a series of substantially parallel score lines into a first intermediate side panel, a first interior side panel, a bottom panel, a second interior side panel, a second intermediate side panel, a first exterior side panel, a top panel, and a second exterior panel, said panels being serially connected by said score lines, an interior aperture formed in each of said intermediate and interior side panels, each of said apertures having first diagonal edges extending from the score line between said intermediate and interior side panels toward the edge of said intermediate side panel opposite said interior side panel, said first diagonal edges being substantially perpendicular to each other, second diagonal edges extending from said score line between said intermediate and interior side panels to the score line between said interior side panel and said bottom panel, said second diagonal edges being substantially perpendicular to each other, said first and second edges meeting at said score line between said intermediate and interior side panels, said first and second adjacent diagonal edges being substantially perpendicualr to each other whereby said first and second adjacent diagonal edges will be substantially aligned in the formed protector, and exterior apertures formed in the exterior side panels, said exterior apertures being formed by third diagonal edges in said exterior side panels which will be aligned with the first diagonal edges in the formed protector and additional edges in said top panel.

2. The blank of claim 1 in which said second edges extend approximately to the score line at the side edge of the bottom panel.

3. The blank of claims 1 or 2 in which a fifth edge extends between said first edges and is parallel to the outer edge of the intermediate side panel.

4. The blank of claim 1 in which said bottom panel has a pair of spacer tabs formed by a transverse score line and cuts which are substantially aligned with the score lines on each side edge of said bottom panel.

5. The blank of claim 4 in which said spacer tabs extend outwardly and said transverse score line forms the inner edge of each of said spacer tabs.

6. The blank of claim 4 in which said spacer tabs extend inwardly, said transverse score line forms the outer edge of each of said tabs, and a transverse cut line extends between the inner ends of said cuts.

7. The blank of claim 2 in which said additional edges include longitudinal edges in said top panel substantially parallel to said score line between said top panel and said first exterior side panel which form a bridge section in the top panel which is separated from the rest of the top panel by score lines extending between the outer edges of said exterior apertures.

8. The blank of claim 7 in which an additional score line extends across said bridge section, said additional score line being substantially parallel to said bridge score lines and substantially midway between them.

* * * * *